US008302432B2

(12) United States Patent
Chung et al.

(10) Patent No.: US 8,302,432 B2
(45) Date of Patent: Nov. 6, 2012

(54) CIRCULATION AND DRAIN SYSTEM IN A WASHING MACHINE AND A METHOD THEREOF

(75) Inventors: Seung Hwan Chung, Suwon-si (KR); Seung Kwun Ahn, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 714 days.

(21) Appl. No.: 12/369,061

(22) Filed: Feb. 11, 2009

(65) Prior Publication Data

US 2009/0229312 A1 Sep. 17, 2009

(30) Foreign Application Priority Data

Mar. 14, 2008 (KR) ..... 10-2008-0023857

(51) Int. Cl.
*D06F 33/00* (2006.01)

(52) U.S. Cl. ..... 68/12.19; 68/12.01; 417/511

(58) Field of Classification Search ..... 68/12.01, 68/12.19; 8/137, 158; 417/510, 511; 137/15.21
See application file for complete search history.

(56) References Cited

U.S. PATENT DOCUMENTS

| | | | | |
|---|---|---|---|---|
| 2,551,379 | A * | 5/1951 | La Raus et al. | 134/95.3 |
| 3,231,909 | A * | 2/1966 | Candor | 8/159 |
| 4,444,027 | A * | 4/1984 | Ikeda | 68/23.6 |
| 5,842,358 | A * | 12/1998 | Koo et al. | 68/23.7 |

FOREIGN PATENT DOCUMENTS

| | | | |
|---|---|---|---|
| CN | 201006953 | * | 1/2008 |
| CN | 201006953 | Y | 1/2008 |
| KR | 1020070059433 | | 6/2007 |
| KR | 10200070059433 | * | 6/2007 |

* cited by examiner

*Primary Examiner* — Saeed T Chaudhry
(74) *Attorney, Agent, or Firm* — Staas & Halsey LLP

(57) ABSTRACT

A washing machine having an improved structure in circulation and drain of washing water are disclosed. The washing machine includes a main body, a water tub which is disposed in the main body, a drain line in which washing water drained from the water tub flows, a circulation line in which washing water returning to the water tub flows, a discharge line in which washing water discharged out of the main body flows, a pump which flows the washing water such that the washing water drained from the water tub returns to the water tub or is discharged out of the main body, a flow path switching device having a single reciprocating member which opens and closes the circulation line or the discharge line, and an operating unit which operates the flow path switching device.

12 Claims, 8 Drawing Sheets

(a)

(b)

(a)

(b)

(a)

(b)

CIRCULATION AND DRAIN SYSTEM IN A WASHING MACHINE AND A METHOD THEREOF

CROSS-REFERENCE TO RELATED APPLICATION

This application claims the benefit of Korean Patent Application No. 2008-0023857, filed on Mar. 14, 2008 in the Korean Intellectual Property Office, the disclosure of which is incorporated herein by reference.

BACKGROUND OF THE INVENTION

1. Field of the Invention

The present invention relates to a washing machine, and more particularly to a washing machine having an improved structure in circulation and drain of washing water.

2. Description of the Related Art

Recently, a washing machine having a washing water circulation structure, in which washing water is pumped out of a water tub and is restored to the water tub, is being developed and manufactured to improve washing and rinsing performance of the washing machine.

Generally, the washing machine having the circulation structure includes an additional circulation pump for circulation of washing water in addition to a drain pump for drain of washing water which causes problems of complicated inner structure and increase in the manufacturing cost.

In order to improve the problems, Korean Patent Laid-open Publication No. 10-2007-059433 discloses a washing machine which performs drain and circulation operations of washing water using a single pump.

The washing machine disclosed in Korean Patent Laid-open Publication No. 10-2007-059433 includes a pump unit. The pump unit includes a pump casing having a water supply path and a plurality of drain paths, a pump which pumps washing water in the pump casing to the plurality of drain paths, and a plurality of valves installed in the pump casing to open and close the plurality of drain paths, respectively.

However, in the washing machine disclosed in Korean Patent Laid-open Publication No. 10-2007-059433, since the valves having the same number as the drain paths are necessary to open and close the plurality of drain paths, there are still problems of complicating an inner structure and increasing the manufacturing cost.

Further, in the washing machine having the above structure, the plurality of valves should be individually controlled. Thus, there are problems of complicating the control and increasing the possibility of malfunctioning valves.

SUMMARY OF THE INVENTION

The present invention has been made in order to solve the above problems. It is an aspect of the invention to provide a washing machine having a simple structure, a low manufacturing cost and operational reliability by improving a circulation and drain structure of washing water.

Additional aspects and/or advantages of the invention will be set forth in part in the description which follows and, in part, will be obvious from the description, or may be learned by practice of the invention.

In accordance with an aspect of the invention, there is provided a washing machine comprising: a main body; a water tub which is disposed in the main body; a drain line in which washing water drained from the water tub flows; a circulation line in which washing water returning to the water tub flows; a discharge line in which washing water discharged out of the main body flows; a pump which flows the washing water such that the washing water drained from the water tub returns to the water tub or is discharged out of the main body; a flow path switching device having a single reciprocating member which opens and closes the circulation line or the discharge line; and an operating unit which operates the flow path switching device.

Preferably, the flow path switching device further includes a hollow pipe in which the reciprocating member is slidably disposed, the hollow pipe includes a suction port through which the washing water pressed by the pump is sucked, a first drain port connected to the circulation line, and a second drain port connected to the discharge line, and the reciprocating member closes the second drain port and opens the first drain port at a first position, and closes the first drain port and opens the second drain port at a second position.

Preferably, the reciprocating member includes an inner flow path passing through an inside of the reciprocating member, and the inner flow path allows the suction port to communicate with the first drain port at the first position.

Preferably, the flow path switching device further includes a reservoir which accommodates the washing water discharged through the inner flow path of the reciprocating member at the second position.

Preferably, the inner flow path allows the suction port to communicate with the second drain port at the second position.

Preferably, the reciprocating member further includes a sealing member disposed around an outlet of the inner flow path.

Preferably, the pump includes a casing, an impeller which is disposed in the casing, and a driving motor which drives the impeller, and the casing and the hollow pipe are formed as a single body.

Preferably, the washing machine further includes a stopper to define a moving range of the reciprocating member.

Preferably, the washing machine further includes an elastic body to support the reciprocating member, wherein the operating unit is a drawing motor.

Preferably, the operating unit is a solenoid driving unit.

Preferably, the washing machine further includes a rotary drum which is rotatably disposed in the water tub; a brake band which brakes the rotary drum; and a clutch device which intermittently transfers a driving force between a water-extracting shaft coupled to the rotary drum and a washing shaft disposed in a hollow portion of the water-extracting shaft, wherein the operating unit is a drawing motor which operates the flow path switching device, the brake band, and the clutch device at the same time.

Preferably, the clutch device includes a clutch spring which is disposed to selectively fasten the water-extracting shaft and the washing shaft, and a clutch lever which operates the clutch spring, and a brake lever coupled to the brake band, the reciprocating member and the clutch lever are connected to the drawing motor.

In accordance with another aspect of the invention, there is provided a washing machine comprising: a pump which pumps washing water out of a water tub such that the washing water returns to the water tub through a circulation line or is discharged out of a main body through a discharge line; a flow path switching device having a single reciprocating member which is disposed at one side of the pump to open and close the circulation line or the discharge line; and an operating unit which operates the flow path switching device.

In accordance with a further aspect of the invention, there is provided a pump assembly comprising: a casing having a suction port, a first drain port and a second drain port; a single flow generator which is disposed at one side of the casing to compulsorily flow fluid sucked through the suction port toward the first drain port or the second drain port; and a single reciprocating member which opens and closes the first drain port or the second drain port.

Preferably, the reciprocating member closes the second drain port and opens the first drain port at a first position, and closes the first drain port and opens the second drain port at a second position.

Preferably, the reciprocating member includes an inner flow path passing through an inside of the reciprocating member, and the suction port communicates with the first drain port through the inner flow path at the first position.

Preferably, the suction port communicates with the second drain port through the inner flow path at the second position.

In the washing machine according to the present invention, since the circulation line or the discharge line is opened and closed by the single reciprocating member, there are effects of simplifying the structure of the washing machine, reducing the manufacturing cost, and improving operational reliability.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
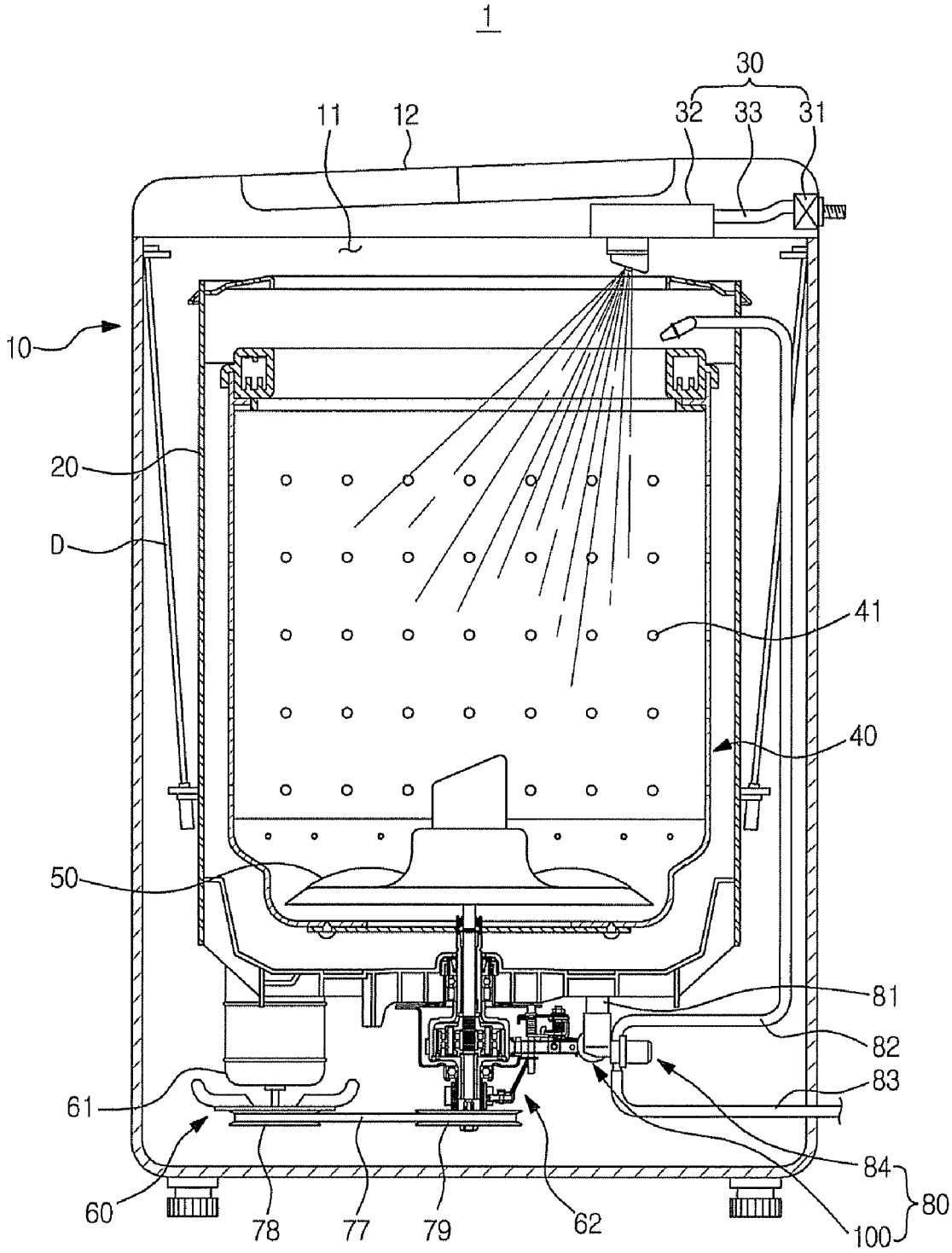
FIG. 1 is a cross-sectional view showing a configuration of a washing machine according to a first embodiment of the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

Hereinafter, embodiments of the present invention will be described in detail with reference to the accompanying drawings.

Figure 2:
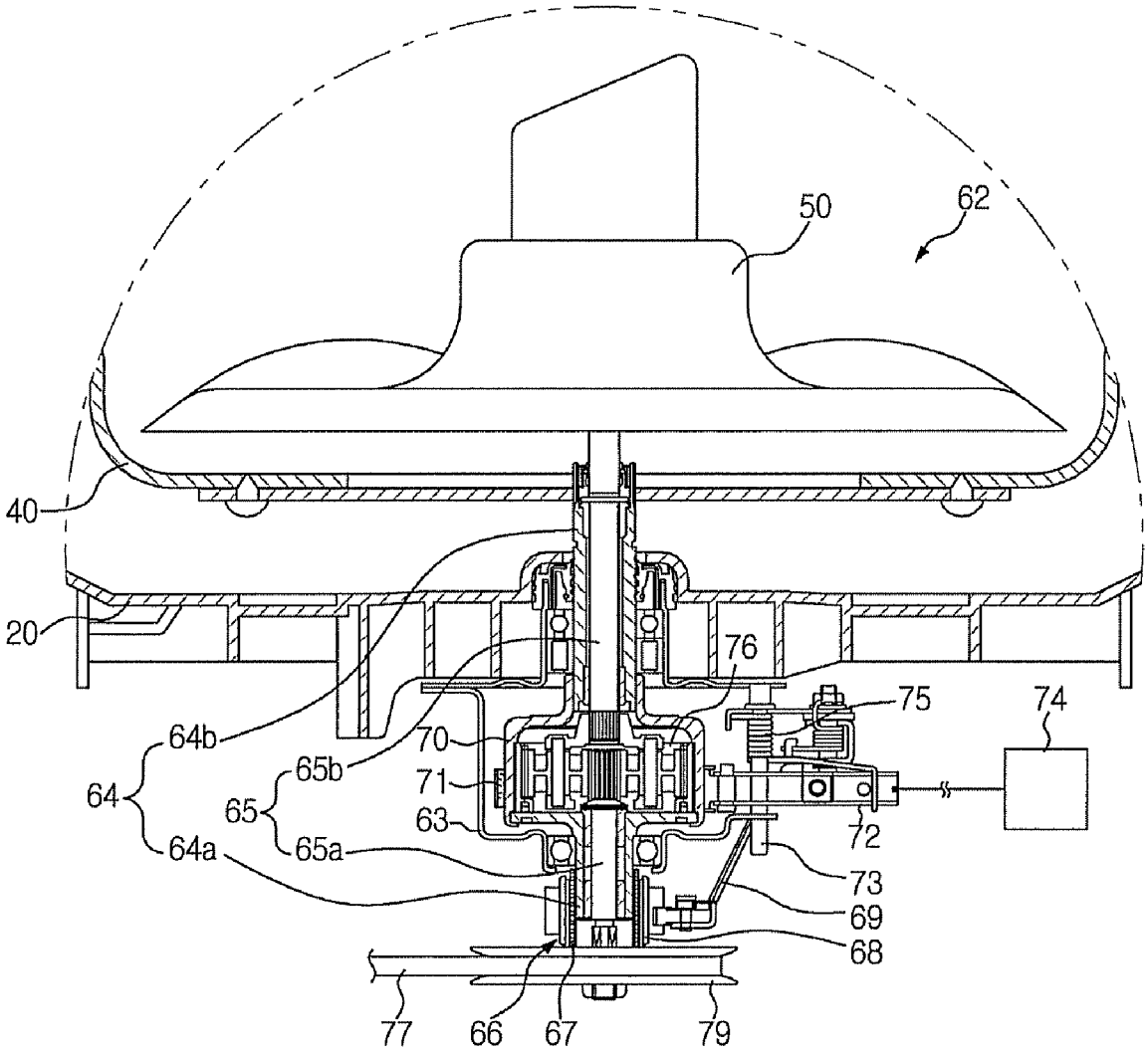
FIG. 2 is an enlarged cross-sectional view of a driving force transfer device of the washing machine according to the first embodiment of the present invention.

FIG. 1 is a cross-sectional view showing a configuration of a washing machine according to a first embodiment of the present invention. FIG. 2 is an enlarged cross-sectional view of a driving force transfer device of the washing machine according to the first embodiment of the present invention.

As shown in FIG. 1, a washing machine 1 according to the present invention includes a main body 10 forming an external appearance of the washing machine 1, a water tub 20 which is installed in the main body 10 to accommodate washing water, a water supply unit 30 which supplies the washing water to the water tub 20, a rotary drum 40 which is rotatably installed in the water tub 20, a pulsator 50 which is rotatably disposed at a lower portion of the rotary drum 40, a driving unit 60 adapted to drive the rotary drum 40 and the pulsator 50, and a pump assembly 80 which pumps the washing water out of the water tub 20 such that the washing water returns to the water tub 20 or is discharged out of the main body 10.

The main body 10 includes a laundry loading port 11 which is formed at an upper portion of the main body 10 to load the laundry, and a cover 12 which is rotatably installed in the main body 10 to open and close the laundry loading port 11.

The water tub 20 is formed in a cylindrical shape with an open upper portion. The water tub 20 is supported by a plurality of suspension units D coupled to a lower outer surface of the water tub 20 while being suspended in the main body 10. The suspension units D attenuate vibration generated in the main body 10 or the water tub 20 in a washing or water-extracting process.

The water supply unit 30 includes a valve 31 which is connected to an external water supply source to control supply of washing water, a detergent supply part 32 which supplies detergent in a water supply process, and a water supply line 33 which connects the valve 31 and the detergent supply part 32. The water supply unit 30 may be disposed at the upper side of the water tub 20.

The rotary drum 40 has an open cylindrical shape. The rotary drum 40 includes a plurality of water-extracting holes 41 on its circumferential surface such that an inner space of the rotary drum 40 communicates with an inner space of the water tub 20.

The pulsator 50 rotates forward and backward to generate a water current, which mixes the laundry in the rotary drum 40 with washing water.

The driving unit 60 includes a driving motor 61 to which power is applied to generate a rotational force, a driving force transfer device 62 which simultaneously or selectively transfers the rotational force of the driving motor 61 to the pulsator 50 and the rotary drum 40, a belt 77 which transfers a driving force between the driving motor 61 and the driving force transfer device 62. Reference numerals 78 and 79 designate a first pulley 78 and a second pulley 79 which are coupled to a rotation shaft of the driving motor 61 and a washing shaft 65 of the driving force transfer device 62, respectively. The belt 77 is connected to the first pulley 78 and the second pulley 79.

As shown in FIG. 2, the driving force transfer device 62 includes a housing 63 which is coupled to a lower portion of the water tub 20, a water-extracting shaft 64 which is rotatably supported in the housing 63 and has one end coupled to the rotary drum 40, the washing shaft 65 which passes through a hollow portion formed in the water-extracting shaft 64 and the rotary drum 40 and has one end coupled to the pulsator 50 and the other end coupled to the second pulley 79, and a clutch device 66 which is installed at a lower end of the water-extracting shaft 64 to intermittently transfer a driving force from the washing shaft 65 to the water-extracting shaft 64.

The water-extracting shaft 64 is divided into a first water-extracting shaft 64*a* and a second water-extracting shaft 64*b*. A brake drum 70 having a cylindrical shape is disposed between the first water-extracting shaft 64*a* and the second water-extracting shaft 64*b* to rotate together with the water-extracting shaft 64. A brake band 71 is disposed at the outside of the brake drum 70 to brake the rotary drum 40 by restricting the brake drum 70. One end of the brake band 71 is fixed to one side of the housing 63, and the other end of the brake band 71 is connected to a brake lever 72.

The washing shaft 65 is divided into a first washing shaft 65*a* and a second washing shaft 65*b*. A planetary gear reducer 76 is disposed between the first washing shaft 65*a* and the second washing shaft 65*b* to reduce a rotational force transferred from the first washing shaft 65*a* to the second washing shaft 65*b*.

The clutch device 66 includes a clutch spring 67 which is disposed to cover both the outer surfaces of the first washing shaft 65*a* and the first water-extracting shaft 64*a*, a cylindrical sleeve 68 which fastens or unfastens the clutch spring 67 to intermittently transfer a rotational force of the washing shaft 65 to the water-extracting shaft 64, and a clutch lever 69 which rotates the sleeve 68. The clutch spring 67 includes one end fixed to the water-extracting shaft 64 and the other end fixed to the inside of the sleeve 68 such that the clutch spring 67 is fastened or unfastened according to the rotation of the sleeve 68.

Meanwhile, the brake lever 72 and the clutch lever 69 are axially coupled to each other by a lever pin 73 and are operated by a drawing motor 74 which rotates the brake lever 72 and the clutch lever 69.

In a state where the drawing motor 74 is not operated, the brake lever 72 and the clutch lever 69 are elastically supported by a coil spring 75 in a rotation direction. In this state, the brake drum 70 is restricted by the brake band 71 such that the brake drum 70 cannot be rotated, and the clutch spring 67 maintains an unfastened state to disconnect the washing shaft 65 and the water-extracting shaft 64. Accordingly, when the driving motor 61 is operated, only the washing shaft 65 is rotated.

When the drawing motor 74 is operated, the brake lever 72 and the clutch lever 69 are rotated in an opposite direction to the rotation direction in which they are elastically supported by the coil spring 75. In this case, the brake drum 70 restricted by the brake band 71 is released and the sleeve 68 is rotated such that the washing shaft 65 and the water-extracting shaft 64 are connected to each other by the clutch spring 67. Accordingly, when the driving motor 61 is operated, the washing shaft 65 and the water-extracting shaft 64 are rotated at the same angular velocity.

The pump assembly 80 is connected to a drain line 81, a circulation line 82 and a discharge line 83, wherein the washing water drained from the water tub 20 flows in the drain line 81, the washing water returning to the water tub 20 flows in the circulation line 82, and the washing water discharged out of the main body 10 of the washing machine 1 flows in the discharge line 83. Accordingly, the pump assembly 80 pumps the washing water out of the water tub 20 such that the washing water returns to the water tub 20 or is discharged out of the main body 10. The structure and operation of the pump assembly 80 are described below.

Figure 3:
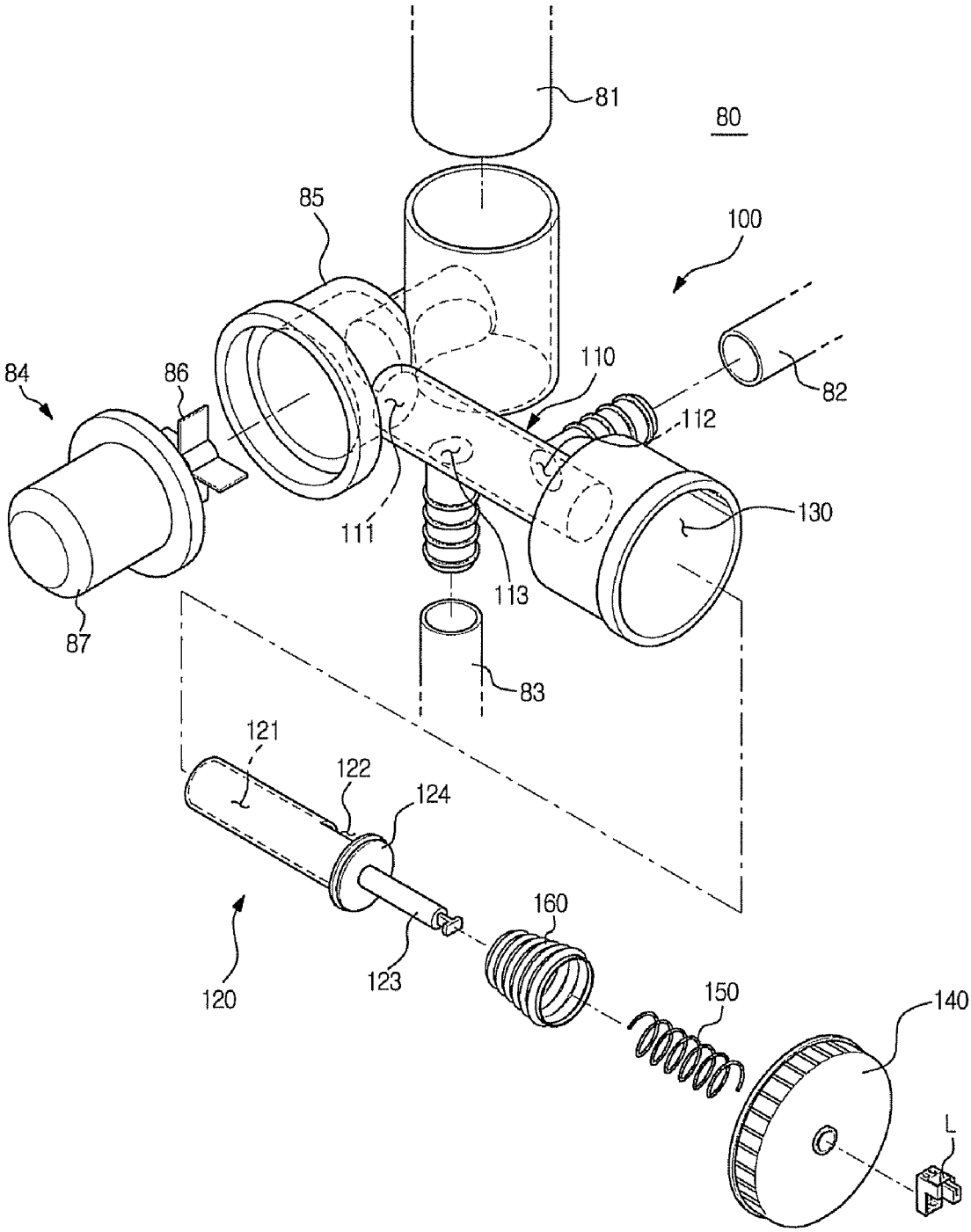
FIG. 3 illustrates an exploded perspective view showing a pump assembly according to the first embodiment of the present invention.
Figure 4:
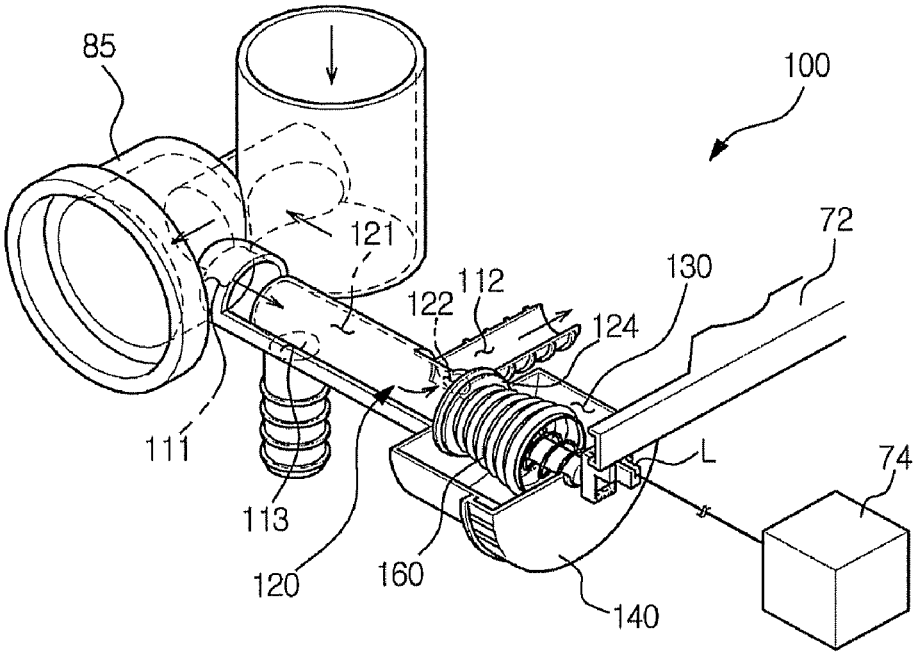
FIGS. 4A and 4B illustrate partial cutaway perspective views showing a flow path switching structure according to the first embodiment of the present invention.
Figure 4:
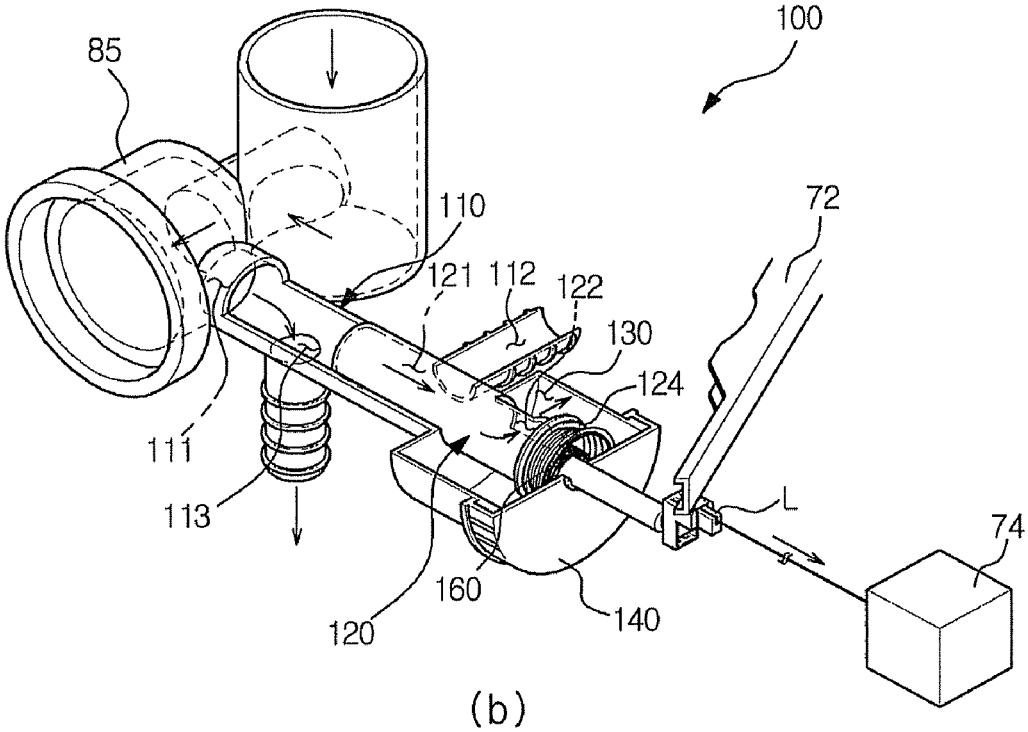

FIG. 3 illustrates an exploded perspective view showing the pump assembly according to the first embodiment of the present invention. FIGS. 4A and 4B illustrate partial cutaway perspective views showing a flow path switching structure according to the first embodiment of the present invention.

As shown in FIG. 3, the pump assembly 80 includes a pump 84 which pumps the washing water such that the washing water drained from the water tub 20 returns to the water tub 20 or is discharged out of the main body 10, and a flow path switching device 100 which opens and closes the circulation line 82 or the discharge line 83.

The pump 84 includes a casing 85, an impeller 86 which is disposed in the casing 85 to generate a water current, and a driving motor 87 which drives the impeller 86. The drain line 81 is connected to one side of the pump 84 such that the washing water in the water tub 20 flows into the casing 85, and the flow path switching device 100 is connected to the other side of the pump 84. Although the pump 84 and the flow path switching device 100 are formed as a single body to form one pump assembly in this embodiment, other ways to arrange the pump 84 and the flow path switching device 100 may be implemented such as an arrangement having the pump 84 disposed as a separate device upstream of the flow path switching device 100 and the flow path switching device 100 being disposed at the end portion of the drain line 81.

The flow path switching device 100 includes a hollow pipe 110 and a reciprocating member 120 which is slidably disposed in a hollow portion of the hollow pipe 110.

The hollow pipe 110 includes a suction port 111 to which the washing water pressured by the pump 84 is introduced, a first drain port 112 connected to the circulation line 82, and a second drain port 113 connected to the discharge line 83.

The reciprocating member 120 includes an inner flow path 121 passing through the inside of the reciprocating member 120. The reciprocating member 120 opens and closes the first drain port 112 or the second drain port 113 such that the washing water pressured by the pump 84 flows through the circulation line 82 or the discharge line 83.

In a case where the reciprocating member 120 is positioned as shown in FIG. 4A, an outlet 122 of the inner flow path 121 faces the first drain port 112. Accordingly, the suction port 111 communicates with the circulation line 82 connected to the first drain port 112 through the inner flow path 121 of the reciprocating member 120, and the second drain port 113 is closed by the outer surface of the reciprocating member 120.

In a case where the reciprocating member 120 is positioned as shown in FIG. 4B, the second drain port 113 is opened and the first drain port 112 is closed by the reciprocating member 120. Accordingly, the washing water flows into the discharge line 83 connected to the second drain port 113.

Therefore, the flow path switching device 100 according to the present invention simply moves the reciprocating member 120 forward and backward to open and close a circulation flow path to which the washing water pumped from the water tub returns or a discharge flow path through which the washing water pumped from the water tub is discharged out of the main body of the washing machine, thereby simplifying the structure of the flow path switching device 100 and a control method thereof, reducing the manufacturing cost of the washing machine, and decreasing possibility of malfunction.

Meanwhile, for convenience of explanation, a position (see FIG. 4A) of the reciprocating member 120, at which the first drain port 112 is opened and the second drain port 113 is closed, is referred to as a first position, and a position (see FIG. 4B) of the reciprocating member 120, at which the second drain port 113 is opened and the first drain port 112 is closed, is referred to as a second position.

As shown in FIGS. 3, 4A and 4B, the flow path switching device 100 further includes a reservoir 130 which accommodates the washing water discharged through the inner flow path 121 of the reciprocating member 120 at the second position (see FIG. 4B), a covering member 140 which closes the reservoir 130, a return spring 150 which elastically supports the reciprocating member 120 such that the reciprocating member 120 is normally positioned at the first position (see FIG. 4A), a sealing member 160 which prevents the washing water of the reservoir 130 from flowing out of the flow path switching device 100, and the drawing motor 74 which draws the elastically supported reciprocating member 120 to operate the flow path switching device 100.

The return spring 150 may be an elastic body of a coil spring shape. A rod 123 coupled to the reciprocating member 120 passes through the return spring 150. One end of the return spring 150 is in contact with the covering member 140 and the other end of the return spring 150 is in contact with a locking part 124 of the reciprocating member 120.

The sealing member 160 is formed in a bellows shape. The return spring 150 is surrounded by the sealing member 160. One end of the sealing member 160 is fixed to the locking part 124 of the reciprocating member 120 and the other end of the sealing member 160 is fixed to the covering member 140.

The drawing motor 74 is connected to both the rod 123 of the reciprocating member 120 and the brake lever 72 of the driving force transfer device 62 through a link member L. Accordingly, when the drawing motor 74 is operated, the brake lever 72 of the driving force transfer device 62 is rotated toward the drawing motor 74, thereby releasing the brake drum 70 restricted by the brake band 71 and connecting the washing shaft 65 and the water-extracting shaft 64 to each other by the clutch spring 67. Consequently, the pulsator 50 connected to the washing shaft 65 and the rotary drum 40 connected to the water-extracting shaft 64 are rotated at the same angular velocity and the water-extracting process is performed. At the same time, the reciprocating member 120 moves backward to the second position (see FIG. 4B) to close the first drain port 112 and open the second drain port 113. The washing water drained from the water tub 20 is discharged out of the main body 10 through the discharge line 83 connected to the second drain port 113.

Accordingly, since the washing machine according to the present invention does not need an additional driving unit to operate the flow path switching device, the structure and the control method of the washing machine are simplified.

Hereinafter, another embodiment of the present invention will be described in detail with reference to the accompanying drawings. However, the description of the same or corresponding components as those described in the first embodiment is omitted.

FIGS. 5A and 5B illustrate cross-sectional views of a flow path switching structure according to the second embodiment of the present invention.

A flow path switching device 200 according to the second embodiment includes a hollow pipe 210, a reciprocating member 220 which is slidably disposed in a hollow portion of the hollow pipe 210, a rod 223 having one end coupled to the reciprocating member 220 and the other end coupled to a drawing motor (not shown), a return spring 250 in which the rod 223 is inserted to elastically support the reciprocating member 220, and a sealing member 260 which prevents outflow of the washing water.

Particularly, the sealing member 260 according to the second embodiment is formed in an annular shape on the front and rear of an outlet 222 of an inner flow path 221. Accordingly, the flow path switching device 200 may have a compact configuration. Of course, the sealing member 260 may be formed in a circular shape to surround the outlet 222 of the inner flow path 221.

Further, the flow path switching device 200 further includes stoppers S1 and S2 which are disposed at the opposite sides of the hollow portion of the hollow pipe 210 to define a moving range of the reciprocating member 220. In a state where the drawing motor 74 is not operated, that is, in a normal state, one side of the reciprocating member 220 is supported by the first stopper S1 and the other end of the reciprocating member 220 is elastically supported by the return spring 250, whereby the reciprocating member 220 is positioned at a first position (see FIG. 5A). In a case where the drawing motor is operated to move the reciprocating member 220 toward the drawing motor, the reciprocating member 220 is drawn by the drawing motor until the movement is restricted by the second stopper S2 and, then, is positioned at a second position (see FIG. 5B). By this configuration, the flow path switching device according to the present invention can transfer the reciprocating member 220 at an accurate position without an additional precision control unit, thereby improving productivity and operational reliability. In the first embodiment of FIGS. 3, 4A and 4B, the locking part 124 disposed on the reciprocating member 120 serves as the stopper.

FIGS. 6A and 6B illustrate cross-sectional views of a flow path switching structure according to a third embodiment of the present invention.

In a flow path switching device 300 according to the third embodiment, when a reciprocating member 320 is positioned at a first position (see FIG. 6A), a suction port 311 communicates with a first drain port 312 through an inner flow path 321 of the reciprocating member 320. When the reciprocating member 320 is positioned at a second position (see FIG. 6B), in the same way, the suction port 311 communicates with a second drain port 313 through the inner flow path 321 of the reciprocating member 320.

FIGS. 7A and 7B illustrate cross-sectional views of a flow path switching structure according to a fourth embodiment of the present invention. The washing machine according to the fourth embodiment includes a solenoid driving unit 470 at one side of the reciprocating member to operate a flow path switching device 400. As in the fourth embodiment, the driving unit adapted to operate the flow path switching device may be replaced by various driving units such as a solenoid driving unit in addition to the drawing motor.

The solenoid driving unit 470 includes an cylindrical armature 471 coupled to the reciprocating member 420, a core 472 which moves the armature 471 forward and backward while closing an open portion of a hollow pipe 410, a return spring 450 which is disposed between the armature 471 and the core 472 to provide an elastic restoration force to the armature such that the reciprocating member 420 is positioned at a first position (see FIG. 7A) in a normal state, and a female coil 473 which is disposed around the core 472 to move the armature 471 forward and backward. Accordingly, when power is applied to the female coil 473, the armature 471 moves toward the core 472 by a magnetic force generated between the core 472 and the armature 471 and, at the same time, the reciprocating member 420 is transferred to a second position (see FIG. 7B). Further, when the power applied to the female coil 473 is cut off, since the magnetic force is removed, the reciprocating member 420 is restored to the first position by the return spring 450. A non-described reference numeral 460 designates a sealing member which prevents the washing water from flowing out of the flow path switching device 400.

Figure 5:
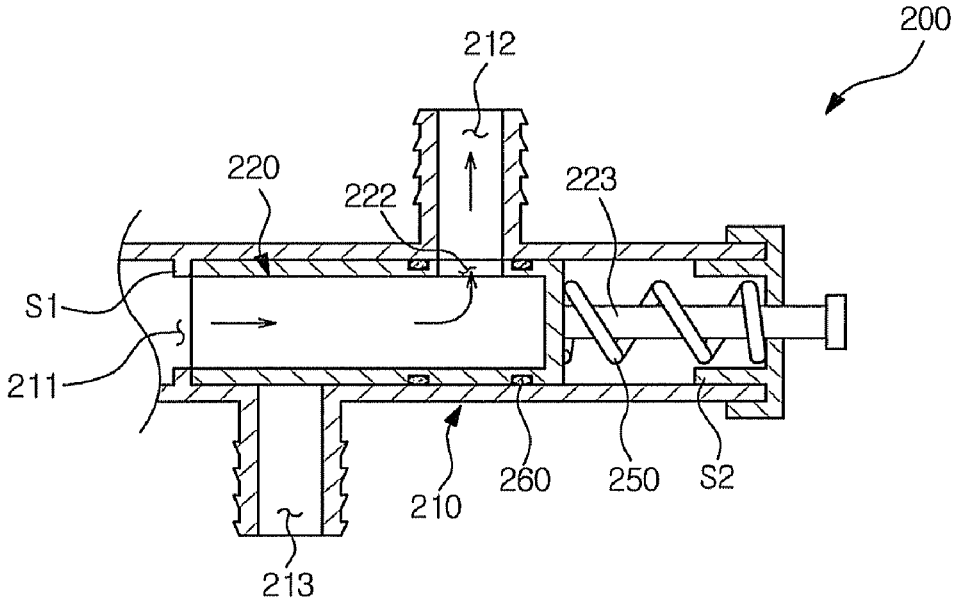
FIGS. 5A and 5B illustrate cross-sectional views of a flow path switching structure according to a second embodiment of the present invention.
Figure 5:
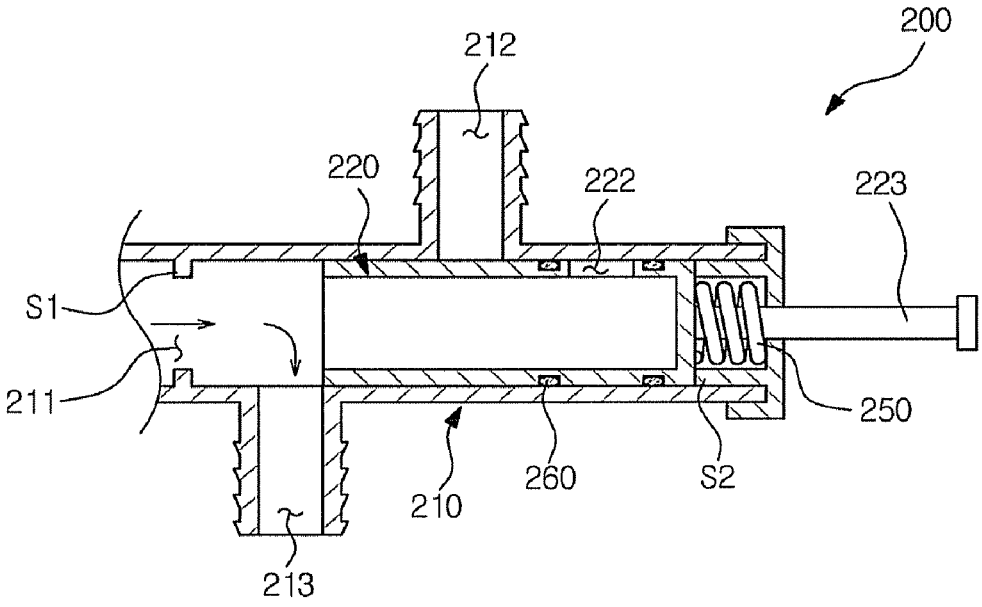
Figure 6:
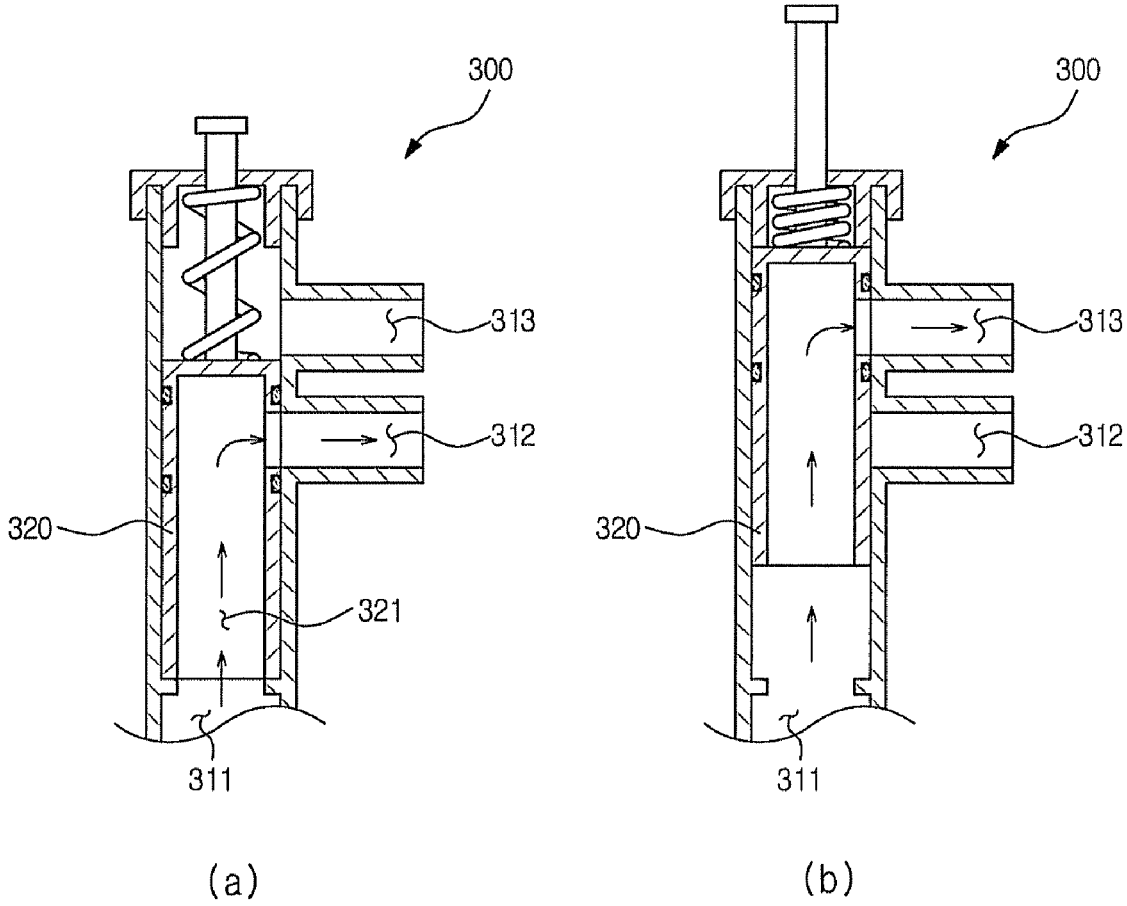
FIGS. 6A and 6B illustrate cross-sectional views of a flow path switching structure according to a third embodiment of the present invention.
Figure 7:
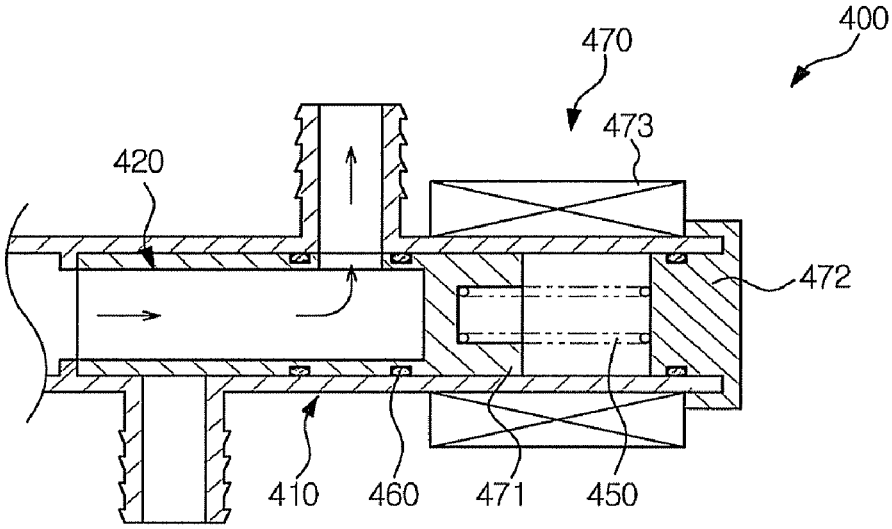
FIGS. 7A and 7B illustrate cross-sectional views of a flow path switching structure according to a fourth embodiment of the present invention.
Figure 7:
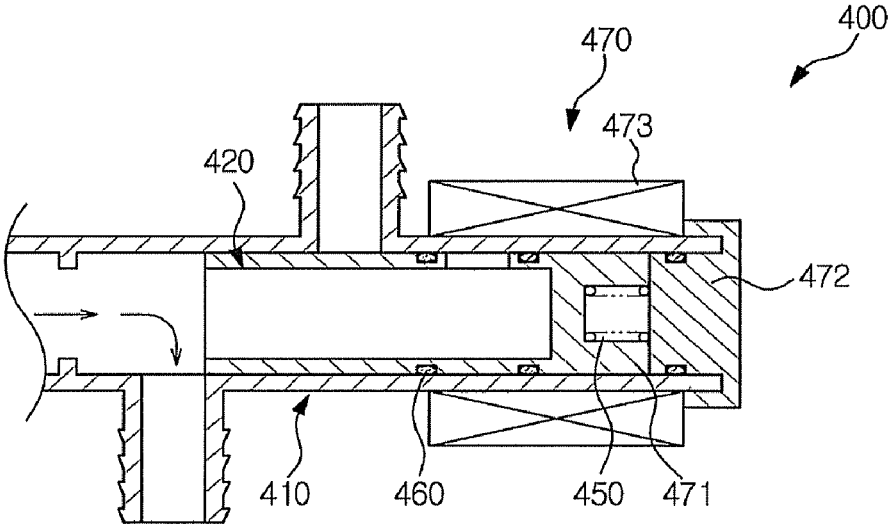

Although the flow path switching structures according to the modified embodiments of the present invention are described in FIGS. 5 to 7, the flow path switching structure according to the present invention may be modified into various shapes.

Figure 8:
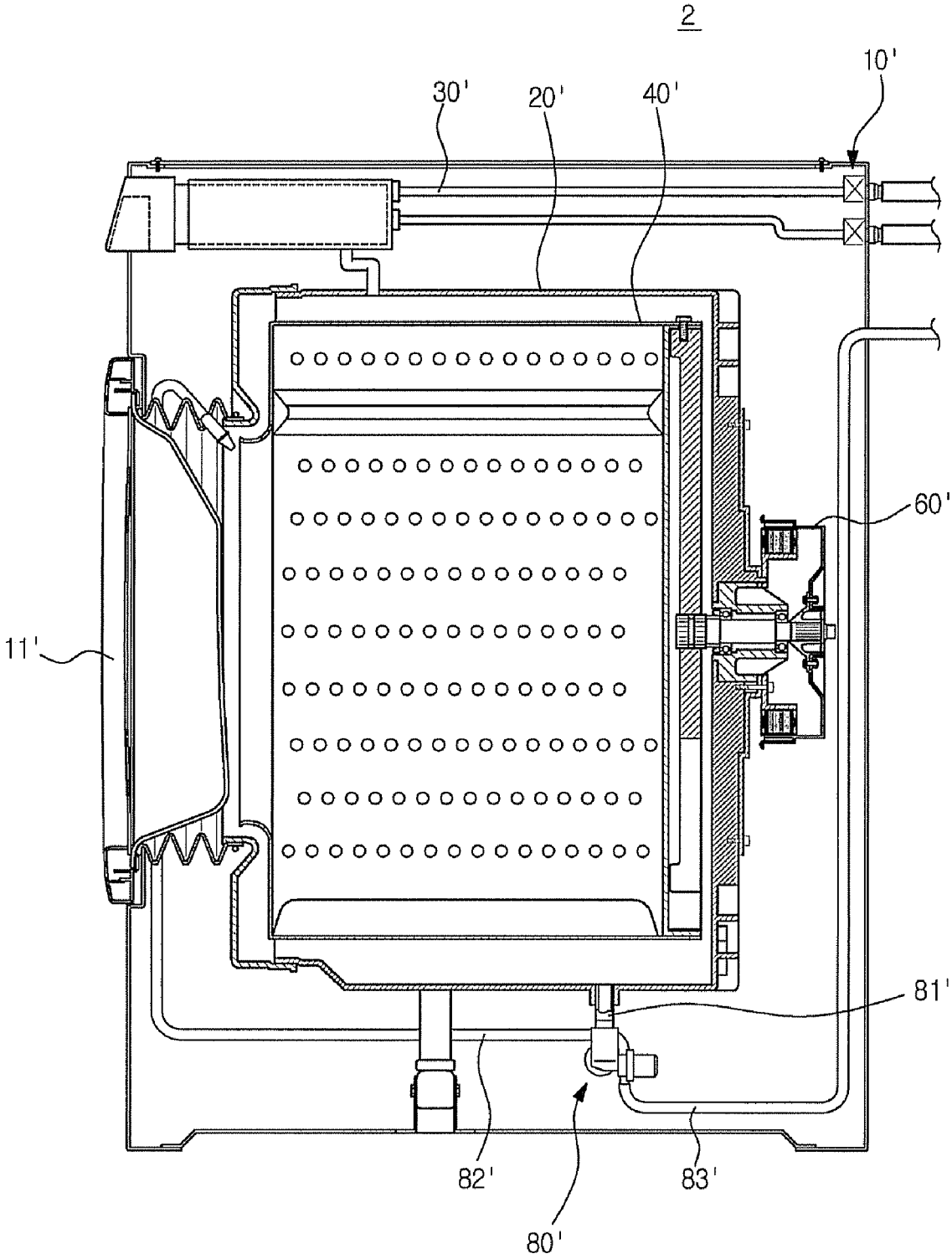
FIG. 8 illustrates a cross-sectional view showing a configuration of a washing machine according to a fifth embodiment of the present invention.

FIG. 8 illustrates a cross-sectional view showing a configuration of a washing machine according to a fifth embodiment of the present invention.

A drum type washing machine 2 according to the fifth embodiment includes a main body 10' which forms an external appearance and has a laundry loading port 11' formed on its front surface, a water tub 20' which is installed in the main body 10' to accommodate washing water, a water supply unit 30' which is installed at an upper portion of the water tub 20' to supply washing water to the water tub 20', a rotary drum 40' which is rotatably installed in the water tub 20', a driving unit 60' which is disposed to rotate the rotary drum 40', and a pump assembly 80' which pumps washing water out of the water tub 20' such that the washing water returns to the water tub 20' or is discharged out of the main body 10'. A non-described reference numeral 81' designates a drain line in which the washing water drained from the water tub 20' flows, and a non-described reference numeral 82' designates a circulation line in which the washing water returning to the water tub 20' flows. Further, a non-described reference numeral 83' designates a discharge line in which the washing water discharged out of the main body 10' of the washing machine 2 flows.

In this case, since other configurations except the pump assembly 80' are the same as those of a general washing machine, the detail description thereof is omitted.

Further, the pump assembly 80' disposed in the washing machine 2 according to the fifth embodiment has the same configuration as the pump assemblies of the first to fourth embodiments except that the pump assembly 80' includes an additional driving unit (drawing motor, solenoid driving unit or the like) to operate the reciprocating member. In other words, since the drum type washing machine 2 according to the fifth embodiment does not include the driving force transfer device of the pulsator type washing machine shown in FIG. 1, the drum type washing machine 2 includes an additional driving unit to operate the reciprocating member.

The washing water circulation and drain operations of the washing machines 1 and 2 according to the present invention are explained in brief.

If a circulation command is generated from a micom (not shown) during a washing or rinsing process, the operation of the driving motor 61 is started. The washing water is pumped out of the water tub 20 or 20' by the operation of the driving motor 61. Then, the washing water returns to the water tub 20 or 20' through the circulation line 82 or 82'. In this case, the drain line 81 or 81' communicates with the circulation line 82 or 82' and the discharge line 83 or 83' is closed by the flow path switching device 100.

If a drain command is generated from the micom, for example, after the washing process, the drawing motor 74 draws the reciprocating member 120 of the flow path switching device 100, 200, 300 or 400. Accordingly, the drain line 81 or 81' communicates with the circulation line 82 or 82' and the discharge line 83 or 83' is closed. Accordingly, the washing water in the water tub 20 or 20' is pumped or naturally discharged out of the main body 10 or 10'.

Although the pump assembly according to the present invention is applied to the washing machine in the above embodiments, the pump assembly according to the present invention may be also applied to other products in addition to the washing machine.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A washing machine comprising:

a main body;

a water tub which is disposed in the main body;

a drain line in which washing water drained from the water tub flows;

a circulation line in which washing water returning to the water tub flows;

a discharge line in which washing water discharged out of the main body flows;

a pump which flows the washing water such that the washing water drained from the water tub returns to the water tub or is discharged out of the main body;

a flow path switching device having a single reciprocating member which opens and closes the circulation line or the discharge line; and an operating unit which operates the flow path switching device, wherein the flow path switching device further includes a hollow pipe in which the reciprocating member is slidably disposed, the hollow pipe includes a suction port through which the washing water pressured by the pump is sucked, a first drain port connected to the circulation line, and a second drain port connected to the discharge line, wherein the first drain port is farther from the pump than the second drain port, and the reciprocating member is biased such that the reciprocating member closes the second drain port and opens the first drain port at a first position until the operating unit operates the flow path switching device, and closes the first drain port and opens the second drain port at a second position according to an operating state of the operating unit.

2. The washing machine according to claim 1, wherein the reciprocating member includes an inner flow path passing through an inside of the reciprocating member, and the inner flow path allows the suction port to communicate with the first drain port at the first position.

3. The washing machine according to claim 2, wherein the flow path switching device further includes a reservoir which accommodates the washing water discharged through the inner flow path of the reciprocating member at the second position.

4. The washing machine according to claim 2, wherein the inner flow path allows the suction port to communicate with the second drain port at the second position.

5. The washing machine according to claim 2, wherein the reciprocating member further includes a sealing member disposed around an outlet of the inner flow path.

6. The washing machine according to claim 1, wherein the pump includes a casing, an impeller which is disposed in the casing, and a driving motor which drives the impeller, and the casing and the hollow pipe are formed as a single body.

7. The washing machine according to claim 1, further comprising a stopper to define a moving range of the reciprocating member.

8. The washing machine according to claim 1, further comprising an elastic body to support the reciprocating member, wherein the operating unit is a drawing motor.

9. The washing machine according to claim 1, wherein the operating unit is a solenoid driving unit.

10. The washing machine according to claim 1, further comprising a rotary drum which is rotatably disposed in the water tub;

a brake band which brakes the rotary drum; and a clutch device which intermittently transfers a driving force between a water-extracting shaft coupled to the rotary drum and a washing shaft disposed in a hollow portion of the water-extracting shaft, wherein the operating unit is a drawing motor which operates the flow path switching device, the brake band, and the clutch device at the same time.

11. The washing machine according to claim 10, wherein the clutch device includes a clutch spring which is disposed to selectively fasten the water-extracting shaft and the washing shaft, and a clutch lever which operates the clutch spring, and a brake lever coupled to the brake band, the reciprocating member and the clutch lever are connected to the drawing motor.

12. A washing machine comprising:

a pump which pumps washing water out of a water tub such that the washing water returns to the water tub through a circulation line or is discharged out of a main body through a discharge line;

a flow path switching device having a single reciprocating member which is disposed at one side of the pump to open and close the circulation line or the discharge line; and an operating unit which operates the flow path switching device, wherein the flow path switching device further includes a hollow pipe in which the reciprocating member is slidably disposed, the hollow pipe includes a suction port through which the washing water pressured by the pump is sucked, a first drain port connected to the circulation line, and a second drain port connected to the discharge line, wherein the first drain port is farther from the pump than the second drain port, and the reciprocating member is biased such that the reciprocating member closes the second drain port and opens the first drain port at a first position until the operating unit operates the flow path switching device, and closes the first drain port and opens the second drain port at a second position according to an operating state of the operating unit.

* * * * *

UNITED STATES PATENT AND TRADEMARK OFFICE

CERTIFICATE OF CORRECTION

PATENT NO. : 8,302,432 B2
APPLICATION NO. : 12/369061
DATED : November 6, 2012
INVENTOR(S) : Seung Hwan Chung et al.

It is certified that error appears in the above-identified patent and that said Letters Patent is hereby corrected as shown below:

Title Page Col. 2 (Foreign Patent Documents); Line 4, Delete "10200070059433" and insert -- 1020070059433 --, therefor.

Signed and Sealed this
Seventh Day of May, 2013

Teresa Stanek Rea

Teresa Stanek Rea
*Acting Director of the United States Patent and Trademark Office*